US010717634B2

(12) United States Patent
Hall et al.

(10) Patent No.: US 10,717,634 B2
(45) Date of Patent: Jul. 21, 2020

(54) RELEASABLE LINE GUIDE

(71) Applicant: Hall Labs, LLC, Provo, UT (US)

(72) Inventors: David R. Hall, Provo, UT (US); Jerome Miles, Spanish Fork, UT (US); Daniel Madsen, Vineyard, UT (US); Dustin Clouse, Springville, UT (US)

(73) Assignee: Hall Labs LLC, Provo, UT (US)

( * ) Notice: Subject to any disclaimer, the term of this patent is extended or adjusted under 35 U.S.C. 154(b) by 109 days.

(21) Appl. No.: 16/034,175

(22) Filed: Jul. 12, 2018

(65) Prior Publication Data

US 2020/0017339 A1 Jan. 16, 2020

(51) Int. Cl.
*B66D 1/38* (2006.01)
*B66D 1/50* (2006.01)

(52) U.S. Cl.
CPC *B66D 1/38* (2013.01); *B66D 1/50* (2013.01)

(58) Field of Classification Search
CPC ..... B66D 1/36; B66D 2700/0191
See application file for complete search history.

(56) References Cited

U.S. PATENT DOCUMENTS 1,646,804 A * 10/1927 Westwood ..... B66D 1/36 242/397.3
1,820,094 A * 8/1931 Smith ..... B66D 1/36 242/397.3
2,163,914 A * 6/1939 Pearson ..... A01K 89/0155 242/292
2,312,576 A * 3/1943 Nelson ..... A01K 89/01917 242/286
2,421,269 A * 5/1947 Joyce ..... B66D 1/36 242/397.3
2,660,382 A * 11/1953 Wilson ..... B66D 1/36 242/478.2
2,892,570 A * 6/1959 Thoresen ..... G01F 15/001 222/20
3,670,988 A * 6/1972 Leonard ..... B66D 1/36 242/397.2
3,809,334 A * 5/1974 Beurer ..... B64D 1/22 242/397.3
5,388,778 A * 2/1995 Morimoto ..... A01K 89/0189 242/261
6,209,816 B1 * 4/2001 Hitomi ..... A01K 89/015 242/322
2002/0003182 A1 * 1/2002 Takikura ..... A01K 89/0114 242/279
2003/0146322 A1 * 8/2003 Kitajima ..... A01K 89/0114 242/249
2007/0108330 A1 * 5/2007 Ikuta ..... A01K 89/01555 242/288
2012/0080652 A1 * 4/2012 Mann ..... B66D 1/7426 254/334

* cited by examiner

*Primary Examiner* — Emmanuel M Marcelo

(57) ABSTRACT

A detachable line guide is provided. A screw with a helical groove is provided. A guide is positioned a fixed distance perpendicular to the screw and can travel laterally freely. The guide includes a follower which is attached to the guide by a spring. The follower is biased into the groove. Rotation of the screw causes the follower to track the groove and move the guide laterally. The guide is configured for a line to pass therethrough. When the line exerts a lateral force above a predetermined threshold against the guide, the follower rides up and out of the groove as the spring is compressed.

18 Claims, 5 Drawing Sheets

RELEASABLE LINE GUIDE

TECHNICAL FIELD

The invention described herein relates generally to spooling.

BACKGROUND

Line guides, capable of keeping a line on track when winding or unwinding the line require the ability to handle forces in multiple directions. In many instances, the human hand is used to guide lines due to the expense and complexity of a line guide as well as due to the human capacity to handle changes in force and direction quickly. When using mechanical devices, such as a line guide for a winch pulling a load via a line, the line guide may experience forces in lateral directions. For example, a winch mounted facing one direction may be pulling on an object to the side of the face of the winch. The force may be partially compensated for by a fairlead, but when the forces become too high laterally, the line guide can be broken.

SUMMARY

In a first aspect, the disclosure provides a screw with a helical groove. A guide is positioned a fixed distance perpendicular to the screw and can travel laterally freely. The guide includes a follower which is attached to the guide by a spring. The follower is biased into the groove. Rotation of the screw causes the follower to track the groove and move the guide laterally. The guide is configured for a line to pass therethrough. When the line exerts a lateral force above a predetermined threshold against the guide, the follower rides up and out of the groove as the spring is compressed.

The guide may be attached to a rod a fixed distance from the screw. The guide can move laterally freely along the rod. The screw and the rod may be held a fixed distance apart by a device. The apparatus may be used in a spooling device such as a spooler or a winch.

The line may consist of a cable, a wire, a line, a cord, twine, a strand, a rope, or any other item which can be wound.

One end of the follower may be tapered. The taper may be asymmetrical being steeper on one portion of the follower than another. The follower may be able to rotate about its axis such that the taper can be aligned with a wall of the groove. The profile of the grooves in the screw may be chamfered, filleted, or tapered to some degree. The chamfer may be asymmetrical, being steeper on one wall of the groove than the other.

The screw may be self-reversing with two counter-rotating helical grooves. The helical grooves may be asymmetrical such that the follower moves more quickly in one lateral direction than an opposite lateral direction The width of the groove may vary along the screw.

The follower may be able to be mechanically actuated to rise over the groove wall, compressing the spring, when a lateral force is sensed above a certain threshold.

The screw and the follower may each have a coating of titanium nitride, titanium carbo-nitride, titanium aluminum nitride, aluminum titanium nitride, chrome nitride, zirconium nitride, chrome, or a combination thereof.

The device may have arms holding the screw and rod which can be moved axially towards the guide.

The guide may be attached to a pipe or tube and may be used to direct fluid flow. The fluid may be supercritical, molten glass, or other liquids and gases.

The apparatus may be used in a 3D printer, additive manufacturing device, or rapid prototyping machine.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
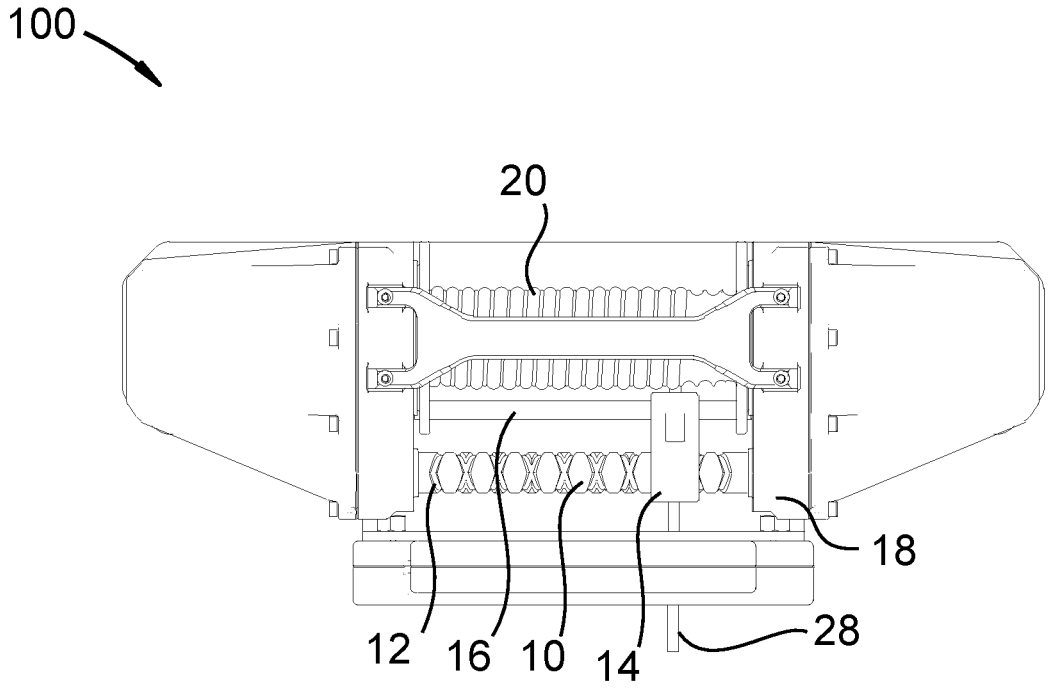
FIG. 1 is a plan view of a spooling device with a screw.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "spooling device" is meant to refer to a device that winds such as a spooler, winch, winder, and coilers.

As used herein, "line" is meant to refer to cable, wire, line, cord, twine, strand, or rope.

Line guides, capable of keeping a line on track when winding or unwinding the line, require the ability to handle forces in multiple directions. In many instances, the human hand is used to guide lines due to the human capacity to handle changes in force and direction quickly. When using mechanical devices, such as a line guide for a winch pulling a load via a line, the line guide may experience forces in lateral directions that are not compensated for by a fairlead, which can break the line guide. A line guide that can be used both with and without lateral loads is disclosed herein. In a preferred embodiment, the line guide is connected to a follower which is mounted on the screw. The screw is preferably a bidirectional helical screw, but any screw can be utilized. The follower tracks the screw as the screw rotates, moving the line guide laterally. The line guide is mounted on a rod or other guide that allows the line guide to move laterally at a fixed distance from the screw. A line passes through the guide. When the line exerts a lateral force against the guide above a force threshold, the follower, containing a spring, is pushed against and up a thread of the screw. The force pushes the follower upward, compressing the spring, until the follower is pushed above the crown of the thread. This disengages the follower from the thread. The line guide then slides laterally until the follower falls into another groove.

Figure 2:
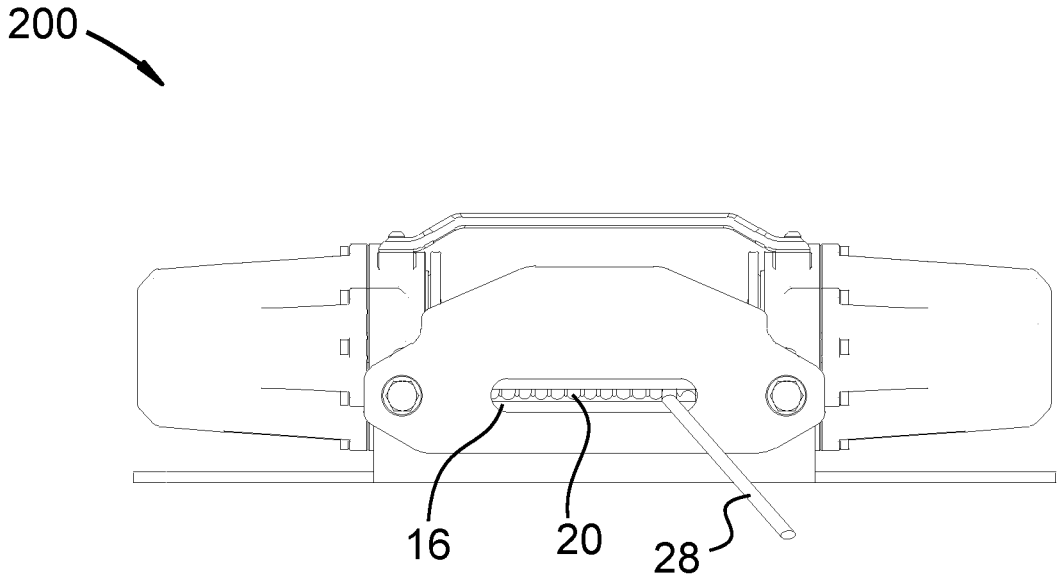
FIG. 2 is a front elevation view of the spooling device of FIG. 1.
Figure 3:
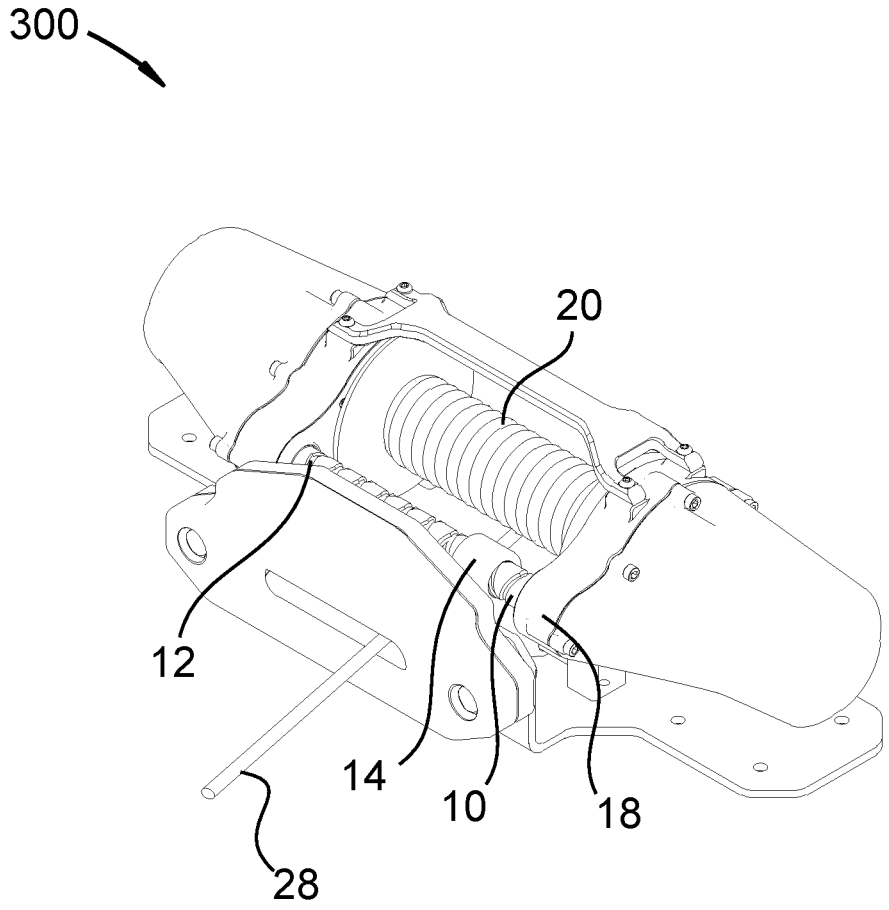
FIG. 3 is an isometric front-top view of the spooling device of FIG. 1.

FIG. 1 is a plan view 100 of a spooling device with a screw that may be used with the devices disclosed herein. The spooling device is a winch. FIG. 2 is a front elevation view 200 of the winch of FIG. 1. FIG. 3 is an isometric front-top view 300 of the winch of FIG. 1. The winch 20 comprises a screw 10 which is self-reversing, consisting of two counter-rotating helical grooves 12. A guide 14 is positioned a fixed distance perpendicular to the screw 10. The guide 14 can travel laterally freely. The guide 14 is attached to a rod 16, parallel to and a fixed distance from the screw 10. The guide 14 can move laterally freely along the rod 16. The guide 14 includes a follower (see FIGS. 4-6 for an example of a follower in an analogous guide) which is attached to the guide 14 by a spring and fits into the groove 12 of the screw 10. Rotation of the screw 10 causes the follower to track the groove 12, moving the guide 14 laterally. The guide 14 is configured for a line 28 to pass therethrough. When the line 28 exerts a lateral force above a predetermined threshold against the guide 14, the follower rides up and out of the groove as the spring is compressed. The follower thereby disengages from the grooves 12.

The line guide 14 has a lateral force that results in the line guide 14 breaking. For example, a guide on a commercially available 12,000 lb rated winch breaks above about 100 lbs of lateral force. In other embodiments, breakage testing of each type of guide will have to be conducted to determine breakage forces.

In all embodiments, the predetermined threshold is below the lateral force at which the line guide breaks. Selection of how far below depends upon the purpose of the line guide. In some embodiments, the line guide is used as an addition to the existing fairlead. In such cases, the predetermined threshold is preferably as close to the force at which the line guide breaks as possible without actually breaking. In some embodiments, this would be no more than 80% of the force at which the line guide breaks. In a more preferred embodiment, this would be no more than 90% of the force at which the line guide breaks. In a most preferred embodiment, this would be no more than 95% of the force at which the line guide breaks.

In other embodiments, the purpose of the line guide is not to be load bearing and so the predetermined threshold would be lower. In some embodiments, this would be no more than 50% of the force at which the line guide breaks. In a more preferred embodiment, this would be no more than 30% of the force at which the line guide breaks. In a most preferred embodiment, this would be no more than 10% of the force at which the guide breaks.

In some embodiments, the screw is made of steel or stainless steel, is heat treated, or is surface hardened. In the commercially available 12,0001b rated winch, the screw can have a diameter of between 6 mm and 12 mm with a pitch of 6 mm. In other embodiments, the pitch and motor gearing would require modification to the keep the coils of line next to each other. Incorrect pitch and gearing leads to spooling that either bunches up or has gaps. Selection of these parameters is within the abilities of a person of normal skill in the art.

In some embodiments, the follower is made of steel, aluminum, or a plastic. The metal chosen should be dissimilar to the metal of the screw.

In some embodiments, the guide is made of plastic or aluminum.

Figure 4:
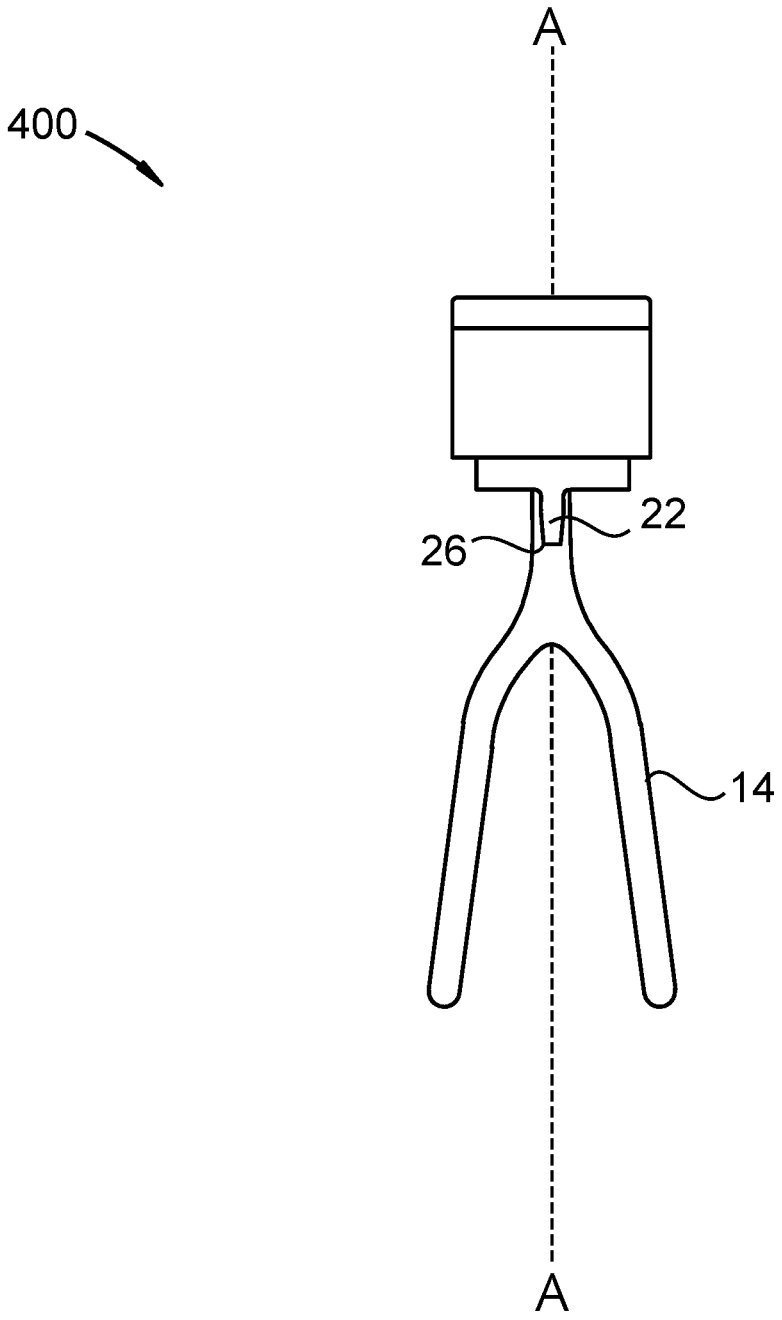
FIG. 4 is a front elevation view of a guide with a follower.
Figure 5:
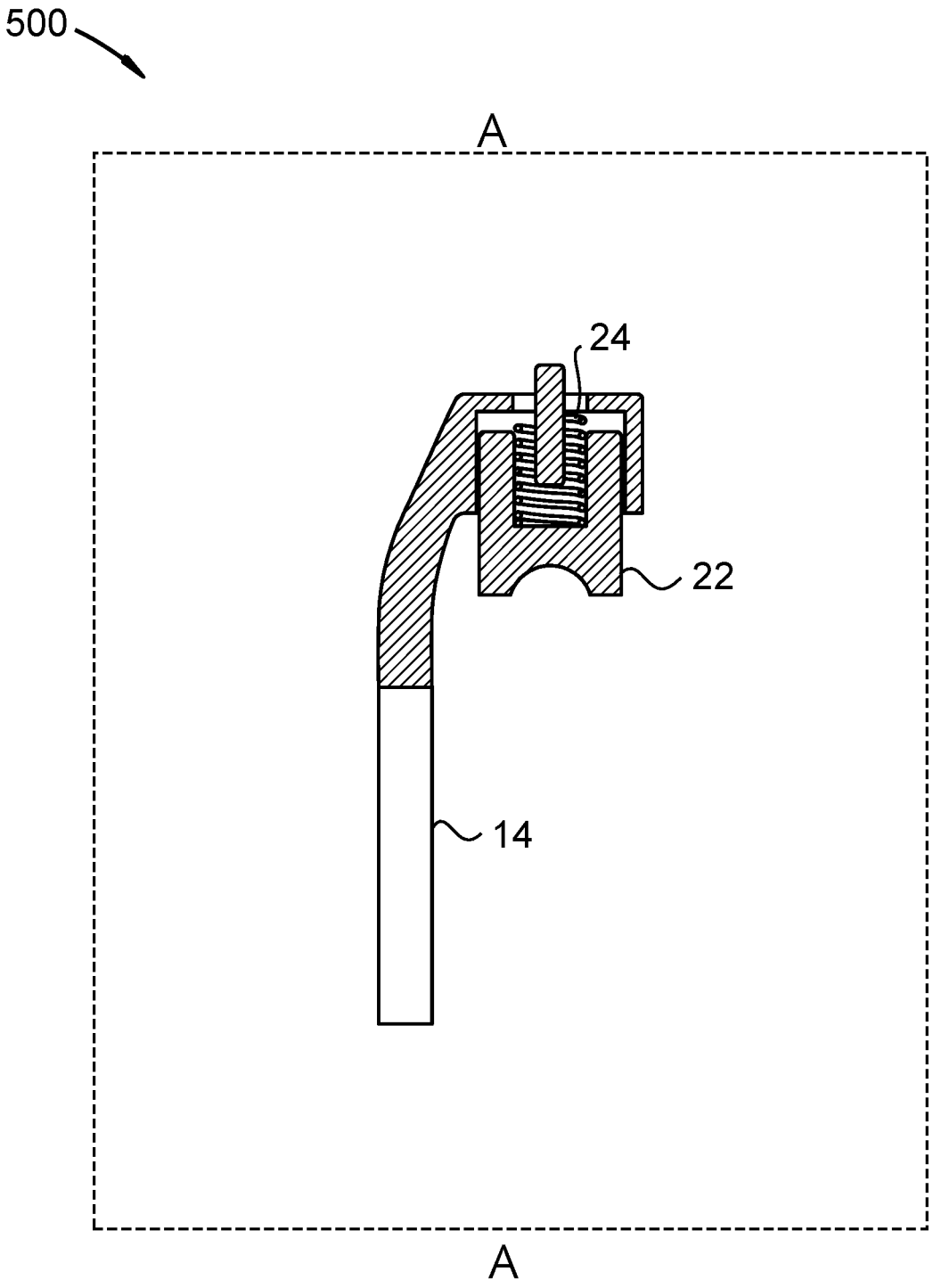
FIG. 5 is a side cross-sectional view of the guide from FIG. 4.
Figure 6:
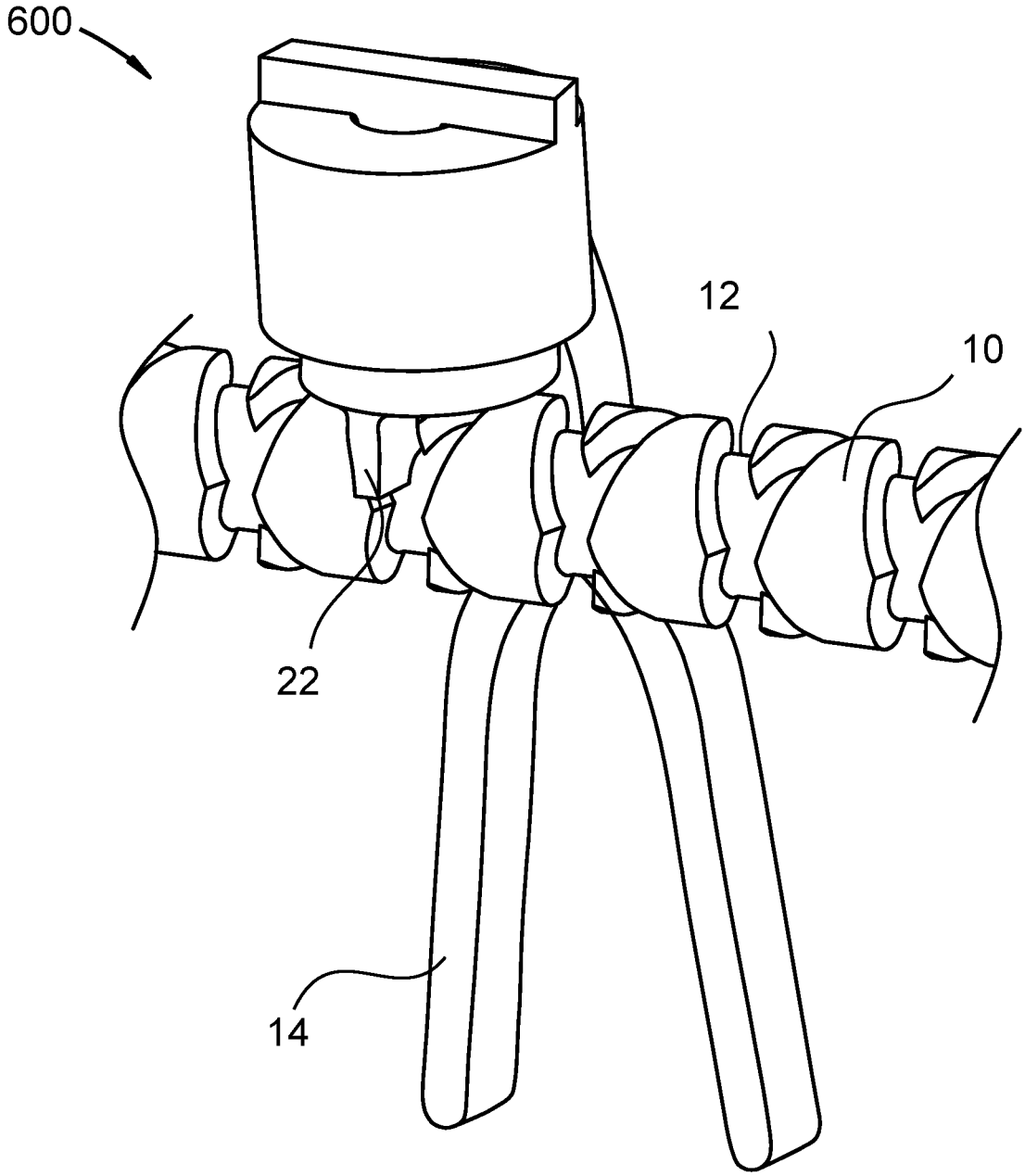
FIG. 6 is an isometric front right view of the guide from FIG. 4 running along the screw of FIG. 1.

FIG. 4 is a front view 400 of a guide comprising a follower that may be used with the devices disclosed herein. FIG. 5 is a cross-sectional view 500 of the guide from FIG. 4 cut along line A-A. FIG. 6 is an isometric view 600 of a fully reversible screw with the guide from FIG. 4. The guide 14 consists of a follower 22 that fits within the groove 12 of the screw 10 wherein rotation of the screw 10 causes the follower 22 to track the groove 12, moving the guide 14 laterally. In this embodiment, one end 26 of the follower 22 is tapered. The walls of the groove 12 are tapered. The follower 22 is allowed to rotate around the vertical axis of the guide 14 to align itself with the direction of the groove 12. The follower 22 attaches to the guide 14 by a spring 24. In some embodiments, the follower 22 can be mechanically actuated to rise over the groove 12 wall, compressing the spring 26, when a lateral force is sensed above a certain threshold.

In some embodiments, the line being spooled may consist of a cable, wire, line, cord, twine, strand, or rope.

In some embodiments, the taper may be asymmetrical, being steeper on one portion of the follower than another. In some embodiments, the taper may be asymmetrical, being steeper on one wall of the groove than the other. In some embodiments, the helical grooves may be asymmetrical such that the follower moves more quickly in one lateral direction than an opposite lateral direction. In some embodiments, the distances between adjacent portions of the thread may vary along the screw.

In some embodiments, the guide may be attached to a pipe or tube and may be used to direct fluid flow. The fluids directed may be supercritical fluids, cryogenic fluids, molten glasses, or a combination thereof.

In some embodiments, the apparatus may be used in a 3D printer, additive manufacturing device, or rapid prototyping machine.

The invention has been described with reference to various specific and preferred embodiments and techniques.

Nevertheless, it is understood that many variations and modifications may be made while remaining within the spirit and scope of the invention.

What is claimed is:

1. An apparatus comprising:

a screw comprising a helical groove;

a guide positioned at a fixed distance perpendicular to the screw, wherein the guide can travel laterally;

a follower attached to the guide by a spring, whereby the follower is biased into the groove, whereby rotation of the screw causes the follower to track the groove and move the guide laterally; and wherein the guide is configured for a line to pass therethrough, wherein, when the line exerts a lateral force above a predetermined threshold against the guide, the follower rides up and out of the groove as the spring is compressed.

2. The apparatus of claim 1, wherein the guide is attached to a rod at the fixed distance, wherein the guide can move laterally freely along the rod.

3. The apparatus of claim 2, wherein a device is used to hold the screw and the rod a fixed distance apart.

4. The apparatus of claim 1, wherein the apparatus is used with a spooling device.

5. The apparatus of claim 4, wherein the line comprises a cable, a wire, a line, a cord, twine, a strand, or a rope.

6. The apparatus of claim 4, wherein the screw is rotated by a first motor and the spooling device is rotated by a second motor.

7. The apparatus of claim 4, wherein the screw and the spooling device are rotated by a motor.

8. The apparatus of claim 1, wherein one end of the follower is tapered.

9. The apparatus of claim 8, wherein the taper is asymmetrical, being steeper on one portion of the follower than another.

10. The apparatus of claim 9, wherein the follower rotates about its axis such that the taper aligns with a wall of the groove.

11. The apparatus of claim 1, wherein the screw comprises a coating selected from the group consisting of titanium nitride, titanium carbo-nitride, titanium aluminum nitride, aluminum titanium nitride, chrome nitride, zirconium nitride, chrome, and combinations thereof.

12. The apparatus of claim 1, wherein the follower comprises a coating selected from the group consisting of titanium nitride, titanium carbo-nitride, titanium aluminum nitride, aluminum titanium nitride, chrome nitride, zirconium nitride, chrome, and combinations thereof.

13. The apparatus of claim 1, wherein profile of the helical groove in the screw is chamfered, filleted, or tapered.

14. The apparatus of claim 13, wherein the taper is asymmetrical, being steeper on one wall of the groove than the other.

15. The apparatus of claim 1, wherein the screw is self-reversing, being comprised of two counter-rotating helical grooves.

16. The apparatus of claim 1, wherein a width of the groove varies along the screw.

17. The apparatus of claim 1, wherein the spring is mechanically actuated when the lateral force is detected above the predetermined threshold.

18. The apparatus of claim 17, further comprising arms holding the screw which can be moved axially towards the guide.

* * * * *